United States Patent [19]

Yackiw

[11] 4,242,392

[45] Dec. 30, 1980

[54] SOFT BARRIER FIN WEATHERSTRIP AND METHOD OF MANUFACTURE

[75] Inventor: Charles Yackiw, Fairport, N.Y.

[73] Assignee: Schlegel Corporation, Rochester, N.Y.

[21] Appl. No.: 85,980

[22] Filed: Oct. 18, 1979

[51] Int. Cl.[3] ..... D04H 11/00; E06B 7/22

[52] U.S. Cl. ..... 428/85; 49/475; 49/489; 156/72; 428/88; 428/92; 428/96

[58] Field of Search ..... 428/85, 88, 92, 96; 49/475, 489; 156/72

[56] References Cited

U.S. PATENT DOCUMENTS

| | | | |
|---|---|---|---|
| 3,175,256 | 3/1965 | Horton | 49/489 |
| 3,404,487 | 10/1968 | Johnson | 156/72 |
| 3,745,053 | 7/1973 | Johnson | 428/85 |
| 4,148,953 | 4/1979 | Horton | 428/85 |

*Primary Examiner*—Marion McCamish
*Attorney, Agent, or Firm*—Cumpston & Shaw

[57] ABSTRACT

The object of this invention is to provide an improved soft barrier fin weatherstrip 10 and method of manufacturing same. The weatherstrip 10, which is used for sealing openings between fixed and sliding members, comprises a soft barrier fin 16 preferably formed from polypropylene material. The fin 16 is coated or impregnated with paraffin which fills the openings or interstices in the fin. The coated fin 16 has good resistance to air and moisture infiltration. The fin 16 further reduces the noise generated by the weatherstrip 10 sliding on a mating surface, and the break-away force required to reverse the direction of the fin. The paraffin in the fin 16 acts as a lubricant between the weatherstrip 10 and mating surface.

14 Claims, 4 Drawing Figures

SOFT BARRIER FIN WEATHERSTRIP AND METHOD OF MANUFACTURE

DESCRIPTION

1. Technical Field

This invention relates to weatherstrips, and particularly to an improved soft barrier fin weatherstrip and method of manufacturing same.

Weatherstripping is used to seal openings between relatively movable fixed and sliding members of panels, doors, windows and the like. It is desirable in such applications to reduce the noise generated by the break-away and sliding friction between the weatherstrip and its mating member. This is achieved by incorporating a soft pervious barrier fin in the weatherstrip which is treated with a waxy material to make it impervious to air and moisture.

2. Background Art

U.S. Pat. No. 4,148,953 describes an air pervious weatherstrip having a base strip, and two longitudinally extending spaced parallel rows of pile attached to the base strip. A soft barrier fin of woven or non-woven synthetic fabric material of polypropylene is positioned in the space between the rows of pile and secured on edge to the base strip. Problems that arise in the use of this prior art air pervious weatherstrip, for example, are (1) excessive leakage of air through the weatherstrip which defeats a basic purpose of the weatherstrip, (2) increased break-away and sliding friction between the fixed and sliding members in some instances where the fin is too soft, (3) high absorption of moisture by the soft fin resulting in possible water leakage through the weatherstrip, and (4) unreliability of the weatherstrip in operation due to the soft fin working its way down between the pile rather than staying upright.

U.S. Pat. No. 3,175,256 relates to a weatherstrip having a base strip and two longitudinally extending parallel spaced rows of pile attached to the base strip. An impervious fin of thermoplastic material such as vinyl, or nylon or glass fiber fabric coated with vinyl is secured on edge to the base strip in the space between the rows of pile. A problem occurring from the use of this prior art weatherstrip, for example, is increased noise due to high break-away and sliding friction between the fixed and movable members.

U.S. Pat. No. 3,404,487 discloses a weatherstrip having a base strip, and a longitudinally extending row of pile attached to the base strip. An adhering and resilient film or coating of a plastic or resinous substance is applied to one or both sides of the row of pile. When the film or coating is cured, it forms a highly effective air and moisture barrier. The coating may comprise plastisols, organisols, plasticized vinyl resins and natural and synthetic rubber. One problem with weatherstrips of this type, for example, is that the film or coating may become brittle and crack due to age, and exposure to the sun and other natural elements. Air and moisture can readily pass through the cracks in the coating thereby greatly reducing its effectiveness as an air and moisture barrier.

DISCLOSURE OF THE INVENTION

In accordance with the present invention, a soft barrier fin weatherstrip and method of manufacturing same is provided for greatly reducing noise generated between the weatherstrip and its mating surface. The weatherstrip comprises a base strip, and preferably two longitudinally extending spaced parallel rows of pile attached to the base strip. A soft barrier fin of woven or non-woven air pervious material is secured on edge to the base strip in the space between the rows, and coated or impregnated with a suitable paraffin, or a wax having similar properties. The paraffin is preferably applied in liquid or melted form onto at least one side surface of the fin, and penetrates through the fin and onto the other side surface by wick action.

To make the weatherstrip, the rows of pile are preferably woven integrally with the base strip and project substantially transverse thereto as well known in the art. The fin is preferably secured to the base strip by welding or the like. The rows of pile are separated from each side surface of the fin, and liquid paraffin applied preferably to one side surface thereof by any suitable applicator such as a commercially available flow gun. In an alternative method of manufacture, the fin is coated with paraffin before it is secured by welding or the like to the backing strip.

The aforementioned problems presented by the prior art weatherstrips are solved by this invention by coating or impregnating the soft pervious barrier fin material with melted or liquid paraffin or any other suitable waxy material or the like having the same general properties as paraffin. The liquid paraffin fills up the holes or interstices in the fin and solidifies making it impervious to air and moisture. Although the paraffin stiffens the fin slightly, it is believed that as soon as the fin is flexed in operation, the paraffin therein breaks along minute lines in or around the holes or interstices in the fin reducing its stiffness without appreciably reducing its resistance to air or moisture infiltration. The paraffin further acts as a lubricant against the sliding surface.

The primary advantage of the weatherstrip of this invention is that it reduces the excessive sliding friction or noise generated by the fin bearing against the mating surface of a fixed or movable member. Another advantage is that it reduces the break-away force needed to reverse the direction of the fin when a member in sliding engagement therewith is moved in the opposite direction. Still another advantage of this weatherstrip is that the soft air and moisture pervious material used as a barrier fin is coated with a waxy material which makes it impervious to air and moisture without losing its softness. Another advantage of this weatherstrip is that the coating used in the fin acts as a lubricating material between the weatherstrip and mating surface of a fixed or movable member.

The invention and its advantages will become more apparent from the detailed description of the invention presented below.

BRIEF DESCRIPTION OF THE DRAWING

The details of this invention will be described in connection with the accompanying drawing, in which.

BEST MODE FOR CARRYING OUT THE INVENTION

Figure 1:
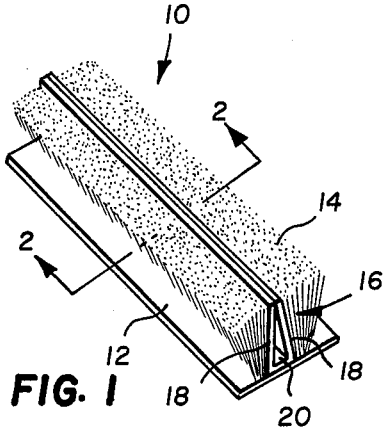
FIG. 1 is a perspective view of the weatherstrip of this invention.

Referring to FIG. 1, a weatherstrip 10 constructed in accordance with a preferred embodiment of the invention comprises a supporting base strip 12 of any conventional material. The base strip 12 suitably is a plastic extrusion of flexible thermoplastic material such as polypropylene.

Preferably a pair of longitudinally extending spaced parallel rows of pile 14 are secured to base strip 12 by conventional means. The pile 14 comprises long upstanding resilient fibers preferably made of known natural or synthetic materials.

A relatively thin soft fin or barrier strip 16 of woven or non-woven pervious material is secured on edge to base strip 12. The fin 16 is positioned between the rows of pile 14 where the weatherstrip has a pair of spaced rows of pile, and is positioned adjacent a row of pile where the weatherstrip has only a single row of pile. The soft pervious material is preferably a fabric of synthetic material such as polypropylene, nylon or the like coated or impregnated with paraffin or any similar waxy material having similar properties. The paraffin, among other things, makes the barrier fin 16 impervious to air and moisture, and functions as a lubricant between fin 16 and the sliding member in contact therewith. The fin 16 is preferably secured to base strip 12 by heating one or both of the fin and base strip to soften the material sufficiently to cause them to adhere tenaciously when pressed or held together. The heating of fin 16 or base strip 12 is achieved by any conventional means such as an ultrasonic horn, for example, not shown.

Figure 2:
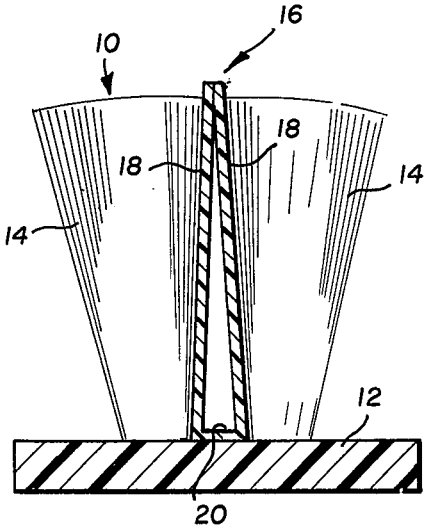
FIG. 2 is a section view taken substantially along line 2—2 of FIG. 1.

With reference to FIG. 2, fin 16 comprises two upstanding legs 18 spaced apart at base strip 12 and joined together there by a cross strip 20. The opposite free ends of the legs are in surface engagement. Although the free ends are shown extending above the height of pile 14, they can vary in height from a desired distance below the pile to any desired distance above the pile depending upon the barrier effect desired.

Figure 3:
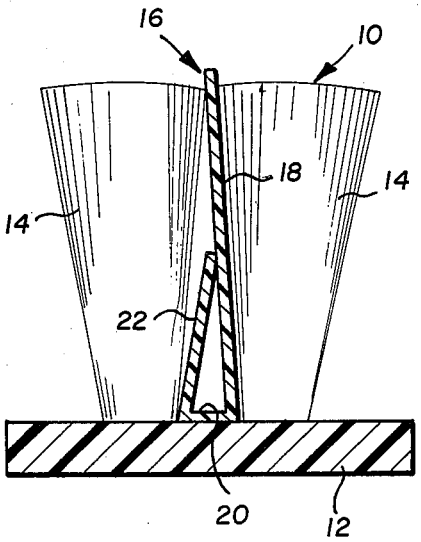
FIG. 3 is a view similar to FIG. 2 of another embodiment of the weatherstrip of this invention.

With reference to FIG. 3, fin 16 comprises a single long leg 18 and a short leg 22 joined together at the base by cross strip 20. The free end of short leg 22 engages long leg 18. With this type of fin 16, only long leg 18 functions as an effective barrier. By varying the length of short leg 22 within limits, it is possible to vary the desired barrier effect of long leg 18. Also, the length of long leg 18 can vary from below the pile height to above the pile height for the desired barrier effect.

Figure 4:
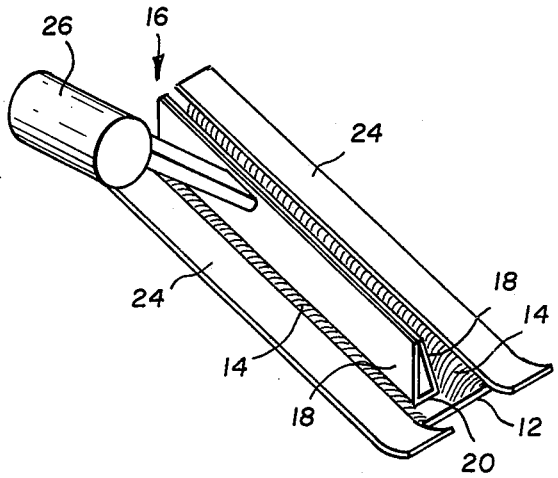
FIG. 4 is a perspective view showing how the paraffin is coated onto the soft fin.

With reference to FIG. 4, a preferred method is disclosed for coating the soft barrier fin 16 with paraffin or the like in liquid form. Means, not shown, transport the weatherstrip in the direction of the arrow causing separator plates 24 to engage and separate the rows of pile 14 from barrier fin 16 for exposing it. Means such as any suitable commercially available material dispensing flow gun 26 designed for high pressure dripless dispensing of moderate to high viscosity materials is provided to dispense a predetermined metered amount of melted paraffin to at least one side surface of leg 18 of the barrier fin. The paraffin penetrates leg 18 and wets cross strip 20 and the other leg 18 by wick action to wet the entire fin 16. The paraffin solidifies adding some stiffness to barrier fin 16 which is believed to be overcome the first time the fin is flexed in use. It is believed that the paraffin probably breaks along minute lines in and around the holes in fin 16 without allowing any appreciable air infiltration therethrough. What is achieved is a soft barrier fin 16 which has good resistance to air and moisture infiltration and reduces friction, noise and break-away force. The paraffin in the fin further acts as a lubricant between the weatherstrip and mating surface to further reduce the sliding friction therebetween.

The invention has been described in detail with particular reference to preferred embodiments, but it will be understood that variations and modifications can be effected within the spirit and scope of the invention.

I claim:

1. A soft barrier fin weatherstrip comprising:

a base strip;

a longitudinally extending row of pile attached to said base strip; and a soft barrier fin of air pervious material secured on edge to said base strip adjacent said row of pile, said fin being coated or impregnated with a waxy material which fills the openings or interstices in said air pervious material so that in use said coated fin maintains its up-right position and effectively resists air and moisture infiltration while retaining its softness.

2. The weatherstrip according to claim 1 wherein said air pervious material is a synthetic material.

3. The weatherstrip according to claim 1 wherein said air pervious material is a polypropylene material.

4. The weatherstrip according to claim 1 wherein said air pervious material is a polypropylene material, and said waxy material is a paraffin material.

5. In a soft barrier fin weatherstrip having a base strip; a pair of longitudinally extending spaced parallel rows of pile attached to said base strip; and a soft barrier fin of air pervious material secured on edge to said base strip between said rows of pile; the improvement comprising coating or impregnating said fin with a waxy material which fills the openings or interstices in said air pervious material so that in use said coated fin maintains its up-right position and effectively resists air and moisture infiltration while retaining its softness.

6. The weatherstrip according to claim 5 wherein said air pervious material is a synthetic material.

7. The weatherstrip according to claim 5 wherein said air pervious material is a polypropylene material.

8. The weatherstrip according to claim 5 wherein said air pervious material is a polypropylene material, and said waxy material is a paraffin material.

9. A method for manufacturing a weatherstrip comprising the steps of:

transporting a base strip having a longitudinally extending up-right row of pile secured thereto;

securing a soft barrier fin of air pervious material on edge to said base strip adjacent said row of pile;

separating said fin from said row of pile as said base strip is transported to expose at least one side surface of said fin; and applying a coating of waxy material to said exposed one side surface of said fin.

10. The method according to claim 9 wherein said waxy material is a paraffin material which permeates said entire fin.

11. The method according to claim 9 wherein a pair of longitudinally extending spaced up-right rows of pile are attached to said base strip, said fin is positioned between said rows of pile, and said waxy material is a paraffin material which permeates said entire fin.

12. A method for manufacturing a weatherstrip comprising the steps of:

transporting a base strip having a longitudinally extending up-right row of pile secured thereto;

applying a coating of a liquid waxy material to at least one side surface of a soft barrier fin of air pervious material; and securing said coated fin on edge to said base strip adjacent said row of pile as said base strip is transported.

13. The method according to claim 12 wherein said waxy material is a paraffin material which permeates said entire fin.

14. The method according to claim 12 wherein a pair of longitudinally extending spaced up-right rows of pile are attached to said base strip, said fin is positioned between said rows of pile, and said waxy material is a paraffin material which permeates said entire fin.

* * * * *